United States Patent [19]

Di Matteo

[11] 4,018,448

[45] Apr. 19, 1977

[54] RECORD FOR THE ARTIFICIAL REPRODUCTION OF SOUNDS

[75] Inventor: Paul Di Matteo, Dix Hills, N.Y.

[73] Assignee: Dynell Electronics Corporation, Melville, N.Y.

[22] Filed: May 14, 1975

[21] Appl. No.: 577,471

Related U.S. Application Data

[60] Division of Ser. No. 406,236, Oct. 15, 1973, Pat. No. 3,885,110, which is a continuation-in-part of Ser. No. 245,484, April 19, 1972, abandoned.

[52] U.S. Cl. ..... 274/42 R; 84/1.18; 84/1.28

[51] Int. Cl.[2] ..... G10H 3/06

[58] Field of Search ..... 179/100.3 V; 84/1.18, 84/1.28, DIG. 29, 1.07, 1.03; 274/42 R, 41.6, 9 RA

[56] References Cited

UNITED STATES PATENTS

| | | | |
|---|---|---|---|
| 1,834,886 | 12/1931 | Barton | 274/42 R |
| 3,007,703 | 11/1961 | Davies | 84/DIG. 29 |
| 3,098,889 | 7/1963 | Buitkus | 84/1.18 |
| 3,212,074 | 10/1965 | Daniels et al. | 274/9 RA |
| 3,324,281 | 6/1967 | Morse | 274/9 RA |
| 3,337,852 | 8/1967 | Lee et al. | 274/9 RA |
| 3,662,363 | 5/1972 | Chertok | 274/42 R |
| 3,931,457 | 1/1976 | Mes | 178/6.6 DD |

*Primary Examiner*—Richard E. Aegerter
*Assistant Examiner*—John W. Shepperd
*Attorney, Agent, or Firm*—Eisenman, Allsopp & Strack

[57] ABSTRACT

There is disclosed a rotatable record for use in the artificial reproduction of sounds, such as musical notes, tones, chords, words, voice phonemes or the like, in which there is at least one endless data track on at least part of which there is recorded one or more sounds to be reproduced and, associated spatially with the sound track, is an endless track on which is recorded information indicating the locations of the component parts of the recorded sound.

2 Claims, 5 Drawing Figures

RECORD FOR THE ARTIFICIAL REPRODUCTION OF SOUNDS

RELATED APPLICATIONS

This application is a division of copending application Ser. No. 406,236, filed Oct. 15, 1973, now U.S. Pat. No. 3,885,110 which is a continuation-in-part of an application Ser. No. 245,484, filed Apr. 19, 1972, now abandoned.

BACKGROUND OF THE INVENTION

The invention is concerned with apparatus for reproducing instantaneously on command recorded sounds, such as recorded, discrete notes of musical instruments, voice phonemes or the like, without objectionable loss of fidelity and, more particularly, to a record for storing the sounds in such fashion that they may be readily accessed and reproduced.

The artificial reproduction of sound patterns, such as music as played by a musical instrument, human speech and the like, has been achieved in the past through the use of synthesizing or simulation techniques based on tone generators which are inherently deficient in their ability to match the true source. It is primarily because of the lack of time varying complex harmonic and amplitude characteristics, which inhere in the true or actual sound which emanates from original sources, that the synthesized sounds lack realism. An obvious solution to the problem is to utilize recording techniques in which, for example, sets of actual notes from an instrument are pre-recorded for retrieval on command in any desired order. While good results are theoretically achievable, the complexity of the equipment necessary to retrieve a recorded sound from storage instantaneously upon command has been heretofore thought to exceed practical limits. For example, the notes from a piano might last from 1 to 10 seconds, and the problem of locating the precise beginning of each recorded track in a dynamic system so that the note will occur immediately upon command has been all but unachievable as a practical matter.

SUMMARY OF THE INVENTION

The retrieval of stored or recorded sound information has been greatly simplified in accordance with the present invention by recording each sound on an endless loop sound track, preferably circular. All of the notes from any desired number of different instruments can, for example, be recorded on separate, endless tracks on one record to be called up for reproduction by means such as a keyboard. The notes can be reproduced singularly or in combination under the control of the operator, and modulating and timing can be subsequently applied to achieve characteristics closely resembling those of the original instrument, all as set forth in said copending application Ser. No. 406,236, filed Oct. 15, 1973.

The record can include, for purposes of gaining access to the sound tracks at any desired point therein, an endless address track bearing a predetermined spatial relation to the sound tracks. In one preferred arrangement, the record can take the form of a disc in which the sound tracks and the address track are recorded in concentric circles. If desired, each circular track can include portions allocated to different sounds.

DESCRIPTION OF THE PREFERRED EMBODIMENT

Figure 1:
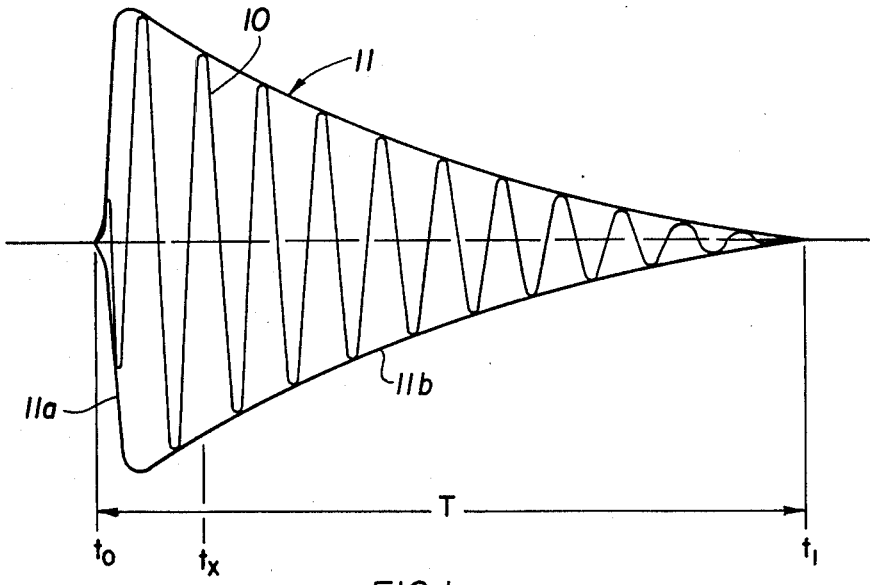
FIG. 1 is a diagrammatic representation of a recorded sound, such as a note from an actual musical instrument, which varies in its character with time and has an envelope rate which is slow as compared to its carrier rate.

Referring to FIG. 1, there is illustrated in diagrammatic and simplified form an actual sound, such as a note from a musical instrument, the sound being represented by a sine wave 10 which decays or attenuates with time to define an envelope 11. The sine wave, in addition to carrying the fundamental frequency of the sound, has imposed thereon harmonics and overtones which (not shown in FIG. 1) distinguish, for example, the quality of a note from a musical instrument and an artificially generated sound at the same frequency. The envelope 11 has a fast-rise or swell portion 11*a* and an attenuation or decay portion 11*b*. The duration of the sound to a point approaching inaudibility is represented by T, the beginning of the sound by $t_o$ and the end by $t_1$. In accordance with the invention of copending application Ser. No. 406,236, filed Oct. 15, 1973, reproduction can be begun at any point between $t_o$ and $t_x$ without degrading to the ears of the listener the quality of the reproduced sound.

Figure 2:
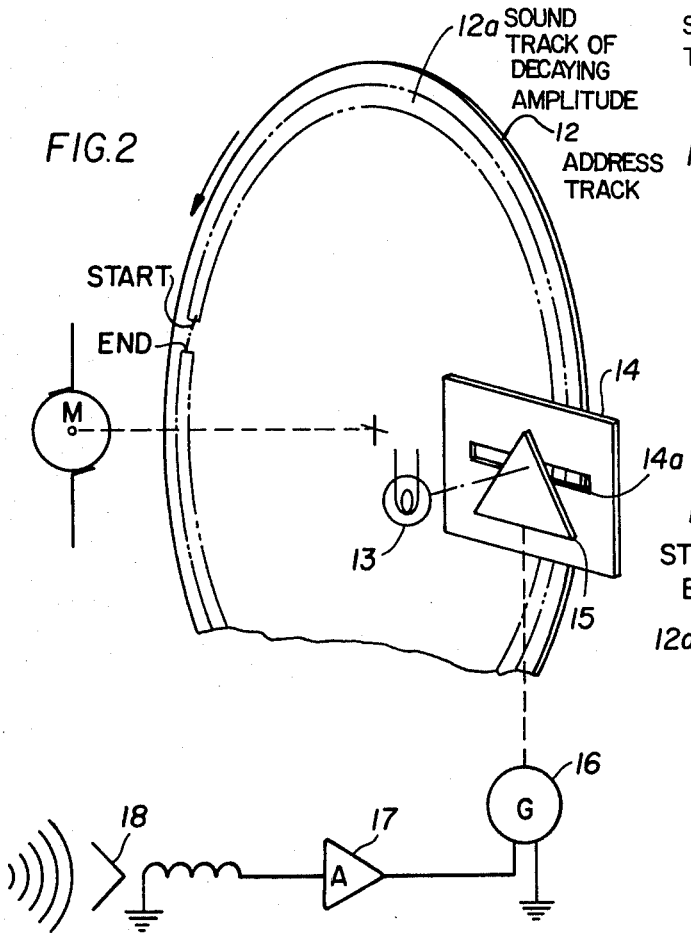
FIG. 2 is a diagrammatic representation of a system for recording the sound of FIG. 1 on a scannable record which is, for purposes of illustration, of the variable area type.
Figure 2A:
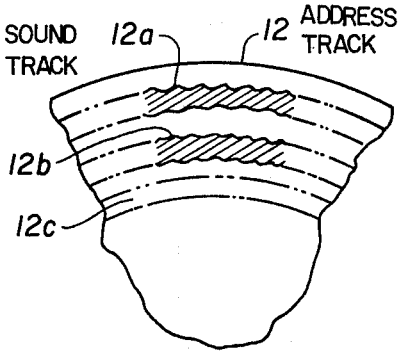
FIG. 2A is a fragmentary view in enlarged scale of a segment of a record showing several optically recorded sound tracks.
Figure 2B:
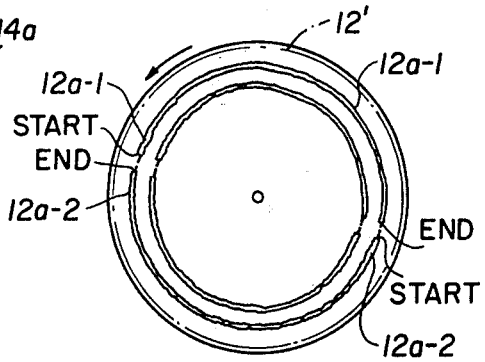
FIG. 2B is a plan view of a record of modified design having two separate sounds recorded in circumferentially spaced relationship in one endless circular track.
Figure 3:
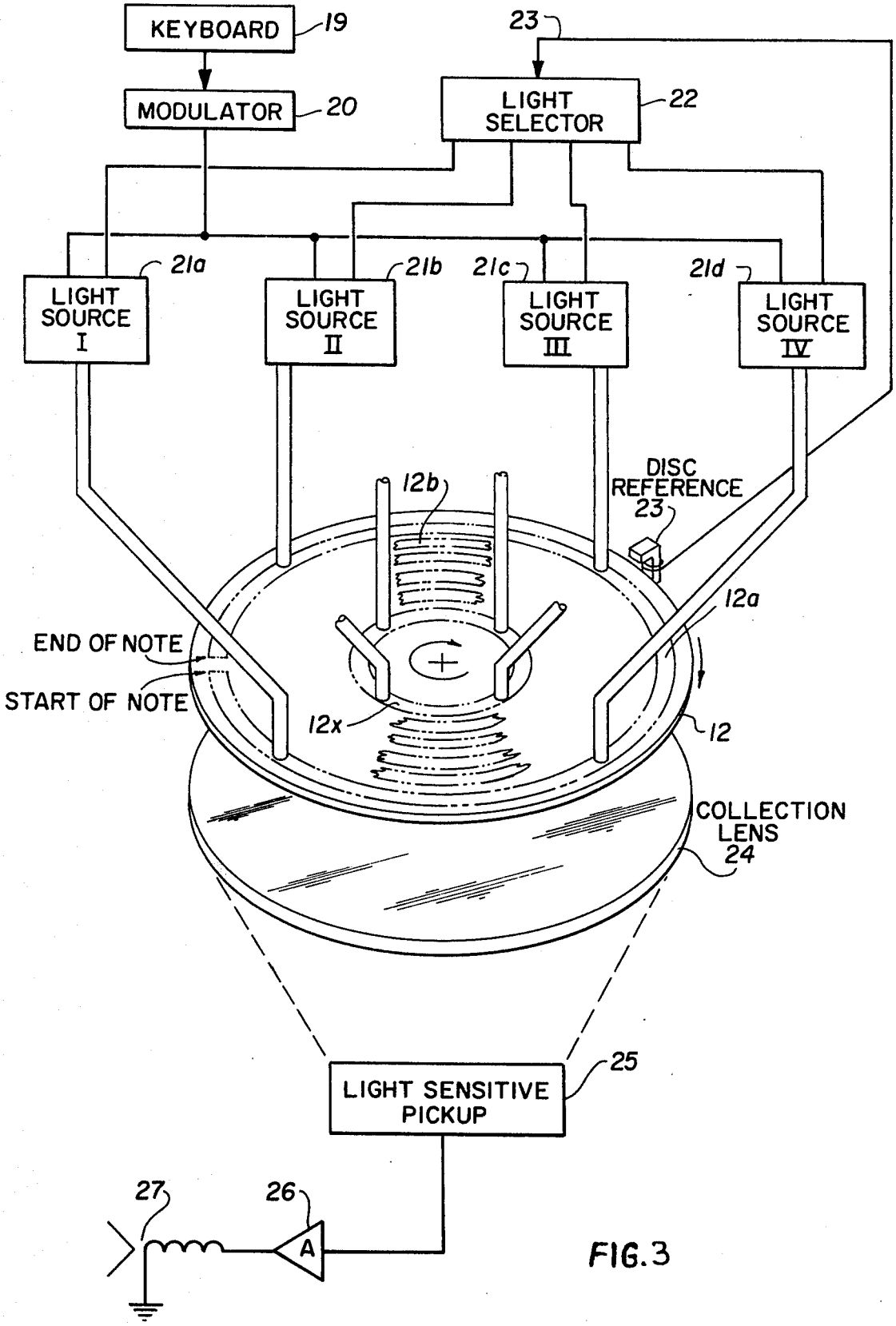
FIG. 3 is a diagrammatic representation of a system for reproducing the sound of FIG. 1.

In accordance with the present invention, actual sounds from original sources, such as the notes of musical instruments, are recorded on a rotary film disc 12 (FIGS. 2, 2A and 3). A plurality of concentric sound tracks 12*a* and 12*b* . . . 12*x* can be recorded on the disc. The record can be made, for example, by using a variable area technique which consists of exposing a film emulsion in a track such that a transparent area proportional to the amplitude of the signal plus a bias proportional to one-half the peak-to-peak amplitude of the signal is developed within the track width. Thus, the sine wave is reduced to a symmetrically undulating track band of varying width. A typical system to effect such recording is illustrated in FIG. 2, in which the disc 12 is rotated in the presence of a collimated light source 13 which is focused through a slotted mask 14 onto the sound track. Eclipsing the slot 14*a* in the mask 14 is a delta-shaped vane 15 driven transversely of the slot by a galvanometer 16 energized by an amplifier 17 to which the output of the recording microphone 18 is connected. The recording is arranged so that the beginning of the sound for each track is discretely located and continues circumferentially around the disc to terminate at a point which can be close to the beginning (for the note of longest duration on the record). The location of the beginning, the end, and of the intermediate points in the sound track is controlled by an address track 12' which can be located, for example, at the periphery of the record in the form of a digital magnetic recording dividing the record into a large number of discrete sections. Address tracks per se are well known in the art and need not, therefore, be described in greater detail herein. If preferred, in accordance with the invention, more than one note can be located in one circumferential track dependent upon the combined note durations. Such arrangement is shown in FIG. 2B in which the outermost sound track is divided into two sections 12*a*-1 and 12*a*-2 each of slightly less than 180° of arc but disposed on the same circle. The address track 12' is correspondingly arranged to indicate either by a special recorded indicator or by means counting the precise beginnings of each of the several discrete sounds recorded in circumferentially spaced relationship around the track. In order to avoid dwells or delays in accessing the desired sounds at the time of playback, additional pickups are used in the playback system, all as described below.

In a typical system, the disc might include recorded thereon all of the notes of many musical instruments including, for example, a piano. When played back in a system shown schematically in FIG. 3, the sound of the piano embodying all of the quality of the original instrument can be achieved. Upon playback, the light that passes through the respective channels or sound tracks on the recording disc 12 will be proportional to the clear or transparent area in the track and, as the disc rotates at constant speed, the light from each channel will describe the signal. The signal from any given track is generated by actuating the appropriate light source associated with the track. In accordance with the invention, a plurality of light sources are associated with each track spaced circumferentially around the disc, with the number of light sources being such that the spacing represents between one-tenth of the envelope rate and the envelope rate of the signal.

The complete system can include an input in the form, for example, of a keyboard 19, with each key comprising an electrical switch. The command signal output of the keyboard can be connected through a modulator 20, the output of which is connected to a plurality of light sources 21*a*, 21*b*, 21*c* and 21*d*. Also connected to each of the light sources is a light-selector circuit 22 under the control of a reference pickup 23 from the disc 12. The reference pickup means 23, the address track and the light selector 22 are well-known in the art and can take the form, for example, of a magnetic sine wave or sequence of pulse generating indicia recorded on the periphery of the disc and thus movable in synchronism therewith so that, as the disc rotates, signals are generated in the pickup coil which indicate the precise beginning of the recorded sounds on the sound tracks and which are counted to indicate how far the disc has rotated from the beginning of the sound. The pickup signals also operate the switching or logic circuitry of the light selector 22. With the disc rotating at a constant speed by a drive motor (not shown), when the operator selects at the keyboard a note corresponding to the outer track on the disc, the reference pickup 23 will immediately inform the light selector 22 as to the location of the start of the note on the disc, and that light source which is closest to the starting point will be energized. Thus, in the illustrated arrangement, the light source 21*a* will be energized and, because its spacing is within the defined limits of the beginning of the track 12*a*, high fidelity reproduction will result. Using the record of FIG. 2B, it will be understood that for equivalent performance, the number of light sources 21 around the circumference of the track will be doubled, i.e. multiplied by the number of discrete sounds on the track.

The system is completed by means of a collection lens 24 which focuses the light passing through one or more of the sound tracks onto a light-sensitive pickup 25 which transduces the signal into an electronic output which is passed through an amplifier 26 to a speaker 27. Special amplitude effects can be accomplished by varying the intensity of the light source illuminating the track, this being accomplished by means of the modulator 20 under the control of the operator.

It will be understood that a wide range of optical techniques can be used for focusing and collecting the light transmitted through the sound tracks including, for example, fiberoptics, prisms, lenses or the like. Also, inputs to the control system can be achieved through keyboard switches, foot pedal devices, automatic controls or, in general, any device which provides a discrete signal representative of a desired sound track or note. Also, while the invention has been described having reference in particular to a musical instrument, such as a piano, virtually all musical instruments are capable of being incorporated in the system. The system can also be used to achieve other sound reproductions including, for example, the human voice.

The invention should not, therefore, be regarded as limited except as defined in the following claims.

I claim:

1. A rotatable record for storing recorded sounds for substantially instantaneous retrieval comprising record means having a plurality of parallel spaced apart endless data tracks, each adapted to present itself continuously to pickup means in a recurring sequence with respect to a beginning point, and each track having means defining at least one sound recorded along its length, each recorded sound having a predetermined beginning point and a predetermined ending point, the amplitude of the sound decaying from the beginning point to the ending point, and an address track on the record with means common to all of the data tracks to define the points of beginning of each sound and all subsequent points throughout the lengths of the data tracks, whereby the sounds of the respective tracks can be accessed at points within a predetermined time interval from the beginning to afford a reproduction which closely approximates the original sound.

2. A record as set forth in claim 1, said record comprising a disc, said plurality of data tracks and address track comprising circular concentric non-intersecting tracks.

* * * * *